US006663495B2

(12) United States Patent
Fun

(10) Patent No.: US 6,663,495 B2
(45) Date of Patent: Dec. 16, 2003

(54) GOLF PRACTICE DEVICE

(76) Inventor: Wey Fun, Blk. 512, #10-508, Bukit Batok St.52, Singapore 650512 (SG)

( * ) Notice: Subject to any disclaimer, the term of this patent is extended or adjusted under 35 U.S.C. 154(b) by 0 days.

(21) Appl. No.: 10/055,784

(22) Filed: Jan. 25, 2002

(65) Prior Publication Data

US 2003/0144067 A1 Jul. 31, 2003

(51) Int. Cl.[7] ..... A63B 69/36
(52) U.S. Cl. ..... 473/180; 473/181
(58) Field of Search ..... 473/158, 173, 473/177, 180, 181, 182, 184, 188, 189, 191, 194, 196, 157, 159, 162–164

(56) References Cited

U.S. PATENT DOCUMENTS 1,887,642 A * 11/1932 Howland ..... 473/189
2,742,294 A * 4/1956 Griswold ..... 473/189
2,974,959 A * 3/1961 Zlotnicki ..... 473/188
3,342,495 A * 9/1967 Wasley ..... 473/164
3,909,007 A * 9/1975 Wuertemburg et al. ..... 473/188
4,429,882 A * 2/1984 Stanton ..... 473/180
4,728,106 A * 3/1988 Shore ..... 473/180
4,906,006 A * 3/1990 Sigunick ..... 473/185
6,193,613 B1 * 2/2001 Alexandres ..... 473/183
6,287,213 B1 * 9/2001 Selton ..... 473/180

* cited by examiner

*Primary Examiner*—Mark S. Graham
(74) *Attorney, Agent, or Firm*—Donn K. Harms

(57) ABSTRACT

A golf practice device, for use in combination with a golf ball which simulates the performance of a real hole of a conventional golf course. The device has a planar base support with a base aperture formed in its top surface to accommodate an appropriately sized base rim for either stationary or rotational engagement therein. A deflector attached to the base rim with an inner surface curved to dissipate a determined amount of the total kinetic energy from the golf ball struck toward the device redirects the ball into or away from a base cavity depending upon the amount of force the ball possesses when it strikes and travels over the curved deflector. Additional dissipation of energy from the golf ball may be achieved by forming the deflector from material which will absorb some of the balls energy when striking the deflector.

17 Claims, 2 Drawing Sheets

GOLF PRACTICE DEVICE

BACKGROUND OF INVENTION

1. Field of Invention

The present invention relates to a device for the practice of a golf swing. More particularly, it relates to a device which simulates a conventional golf hole target for the user to practice hitting a golf ball into the hole without the need for a four inch deep hole or elevated platforms or other large and expensive practice apparatus. The device features a curved deflector designed to redirect balls struck at the proper angle and speed into a base cavity while rejecting balls improperly hit for angle or speed. The hemispherically shaped curved deflector is adjustable for the angle of ball approach during a practice session making it especially easy to relocate for use in different locations.

2. Prior Art

In the United States and throughout the world, the game of golf is a sport and passion of millions of players. From the professional player earning millions of dollars per year to the amateur player, the point of the game is to deposit the golf ball in the hole using the fewest possible strokes of the golf club. As is obvious, such a game requires many hours of practice to develop sufficient skills and muscle memory for the player to be capable of playing on a competitive or even enjoyable level.

Currently, most indoor putting practice systems are based on two designs. A first such conventional golf practice simulator design is based on having a fully elevated planar platform that raises the whole putting surface few inches above ground to provide the depth in the surface for a hole which the player targets during putting practice. This design, though fairly accurate in replicating the properties of actual flat-and-level putting surface, typically costs hundreds of dollars to replicate a small putting surface practice area. Such a system is also not portable and costly to ship.

A second popular golf practice simulator design uses a ramp which ramps the struck ball upward from the hitting surface by a few inches to a second planar surface where the target hole is located. The products based on this design, even though are lower in cost and more portable, they are highly inaccurate in replicating the behavior of a struck golf ball in actual putting situations. The ramping up of the ball to the second planar surface is not an accurate manner for which the golfer to practice hand and eye coordination when imparting force and speed to the ball since the ramp decreases the actual force of the ball driven toward the hole. In real life situations, this is not the normal surface for a ball nor does a putting green have inclines to decrease ball force. This inaccuracy is further aggravated if the ball's path is inclined at an oblique angle to the ramp's front.

The device and embodiments disclosed herein are directed at a highly accurate golf hole synthetizer which allows the user to strike a golf ball at the normal speed and force which would be used on a golf course. Much like an actual hole on a putting green, the device herein disclosed will entrap a ball properly hit at the correct angle and speed, while it will reject balls hit at improper angles and at improper speeds. This allows the user to practice hitting the ball just as would be done on a regular putting green without the inaccuracies caused by ramps and without the high cost of constructing a large flat practice area when the ramp is not used to slow the ball.

U.S. Pat. No. 5,100,147 (Mull) teaches a putting stroke developer which may be used with or without a putting surface element. However, Mull operates by rebounding the ball at a determined angle and speed and requires the user to interpret whether or not the put was acceptable.

U.S. Pat. No. 4,728,106 (Shore) discloses a golf putting practice device which has a rear wall which simulates the rear wall of a golf hole. Shore has two sloping planes in front of a rear wall which blocks balls hit slow enough wherein balls hit too hard, pass over it. However Shore uses inclines in front of the wall and is thus not the same as a level putting green and also is open to user interpretation since it does not actually trap properly hit balls in a hole.

U.S. Pat. No. 3,659,856 (Fatur) features a golf practice putting aid using a pair of long arm portions around a central portion as a target for the golfer. However Fatur does not actually trap the ball in a hole if properly hit and is not based on draining a calculated amount of kinetic energy from the ball to determine if it was properly hit.

As such, there exists a need for an easily and inexpensively manufactured device to aid in the practice of golf putting. Such a device should be easily transported and positionable for practice both indoors and outdoors. Such a device should be situated on a planar surface and not require ramps or inclines to drain energy from the ball to give the user an accurate estimate of the amount of force required to reach the hole viewed at a distance. Such a golf practice device should be configured to measure and drain the kinetic energy from a ball hitting it, and to reject balls hit too hard or at the wrong angle and to entrap balls hit at the proper angle and force thereby alleviating any need for interpretation by the user as to a score.

SUMMARY OF THE INVENTION

Applicant's device provides an easily manufactured and used golf putting practice device. The device as described and disclosed herein is small and light and therefor easily transported for use at a variety of locations and it may be used for practice both indoors and outdoors. The disclosed device in use is placed upon a planar surface a determined distance from the user and requires no ramps or inclines or abutments to drain energy from the struck ball. It consequently gives the user practice gauging the distance to the hole with eyesight and applying the appropriate amount of force to reach the hole viewed at that distance. Thus the user accurately gains practice and resulting hand and eye coordination and muscle memory as to the proper stroke and force to reach a hole at a user viewed distance.

This accurate placement of the hole a determined distance from the user is achieved using a configuration of the device to drain the kinetic energy from a ball hitting the deflector rejecting balls hit too hard or outside a determined correct angle, but entrapping balls hit withing a proper determined angle and determined maximum force. The user thus need not try to interpret the result of hitting the device as with other such practice aids and gains a great amount of practice using the actual stroke and force required to drop the ball in the hole not provided by conventional devices using ramps and berms to slow the ball.

An object of this invention is the provision of a golf putting practice device which avoids the use of ramps and berms and other ball impediments to slow an approaching ball.

Another object of this invention is to provide golf putting practice device which accurately uses and redirects the kinetic energy of the struck ball to accept or reject the ball from containment in the device.

A further object of this invention is the provision of a golf practice device which enables the user to gain accurate hand and eye coordination practice at hitting a golf ball into a hole at a viewed distance by the elimination of impairments to the speed and trajectory of the ball approaching the hole.

Further objects of the invention will be brought out in the following part of the specification, wherein detailed description is for the purpose of fully disclosing the invention without placing limitations thereon.

BRIEF DESCRIPTION OF DRAWING FIGURES

FIG. 1 perspective view of the disclosed device showing the curved main deflector rearward of the base cavity for entrapping properly hit balls.

DETAILED DESCRIPTION OF THE PREFERRED EMBODIMENTS OF THE INVENTION

Figure 1:
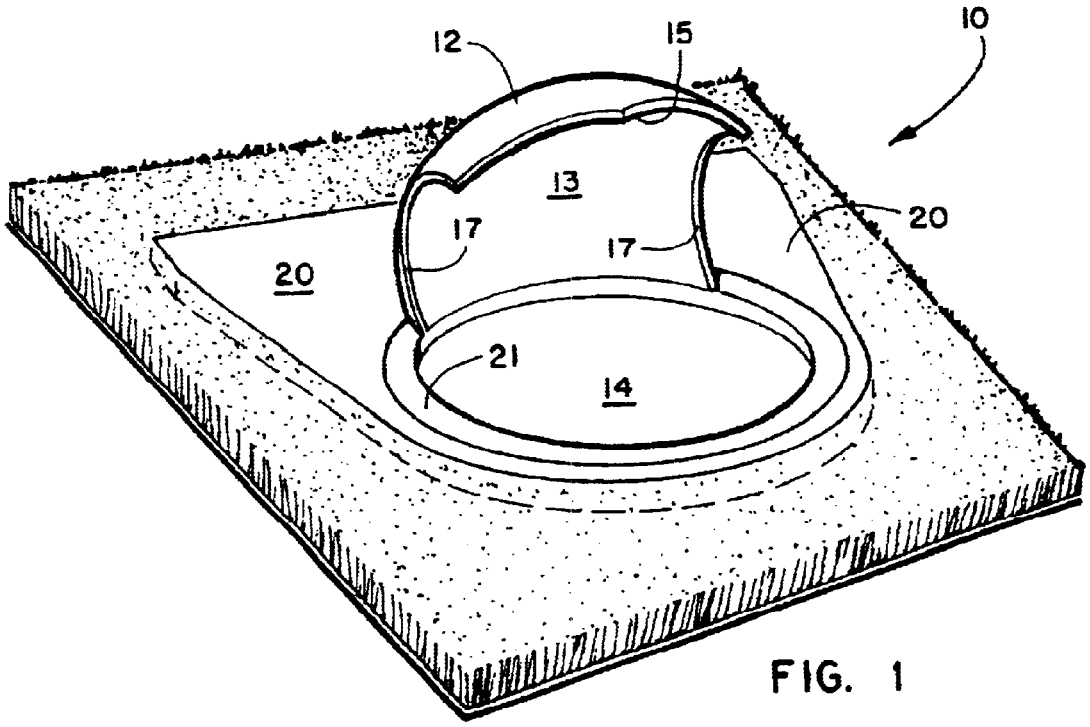

Referring now to the drawing FIGS. 1–5 which depict the preferred embodiments of the invention disclosed herein, specifically FIG. 1 is a perspective view of the disclosed device 10 showing the curved main deflector 12 rearward of the base cavity 14 for entrapping properly hit balls 16 therein.

The base cavity 14 is formed inside the base rim 18 of the device which is sided to fit inside an aperture formed in the support base 20. The top surface 21 of the base rim 18 should be substantially level with the adjacent surface of the support base 20. The base cavity 14 because of the unique operating principals of the base cavity 14 needs only to be only 5 mm deep or recessed below the top surface 21 of the rim 18. Of course those skilled in the art will realize that different configuration of the curve of the main deflector 12 as well as changing the hardness of the material forming it may change this depth requirement and such are anticipated, however the current best mode of the device requires only a 5 mm recess below the top surface 21 to entrap properly hit balls 16. The thickness of the support base 20 of the device 10 is to be determined by the thickness of the chosen putting mat 22 such as carpet or artificial turf to be used in combination with the device 10 during a practice session. As noted, there should be little or no protrusion or sink at the point where the support base 20 abuts or adjoins the putting mat 22 used herewith and where the top surface 21 of the rim 18 abuts the support base 20 that would significantly perturb the ball's 16 rolling onto the support base 20 and over the rim 18 adjacent to the lowered surface of the cavity base 14. In some cases, the support base 20 might be formed by the putting mat 22 itself with a properly dimensioned aperture therein to accommodate the perimeter of the rim 18 in operative engagement therein so as not to come loose during use. In any case, allowance must also be made to accommodate the depth of the base cavity 14 below the top surface 21.

When used with a putting mat 22 an aperture of appropriate dimensions must be created in the putting mat 22 cooperatively engage the perimeter of the device 10 such that the device is robustly secured therein and will not be displaced by a golf ball striking it. The aperture would be the same shape as the perimeter of the support base 20 or in cases where the support base 20 is the putting mat 22 then the shape and exterior dimensions of the rim 18.

Figure 5:
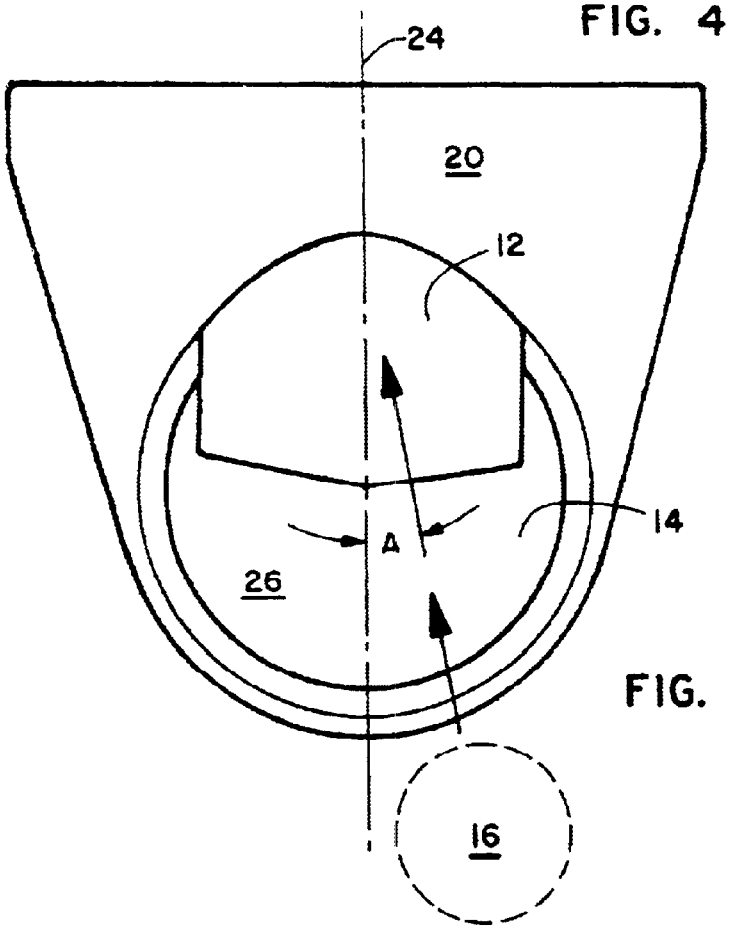
FIG. 5 is second top view showing the symmetry axis.

The rim 18 in the current best mode is rotationally mounted in the support base 20 and the main deflector 12 is attached to the rim 18 about its attachment end. In use, in the preferred embodiment, the main deflector 12 should be adjusted to an orientation such that its symmetrical axis 24 as shown in FIG. 5, is approximately along the direction of the ball's incoming trajectory when struck by the user. The user would have to pre-estimate the ball's trajectory to make such an initial adjustment. This can be done by either changing the relative position of the device 10 and the practice mat 22 holding it to accommodate the position of the user at the desired angle, or, by rotating the rim 18 in its rotational engagement in the aperture formed in the base support 20 to line up the symmetrical axis 24 with the ball position prior to being struck during practice.

Since the device 10 in the current best mode functions quite accurately if the ball's trajectory at contact with the main deflector 12 is inclined at an angle A from the symmetrical axis 24 which is currently plus or minus 5 degrees of its symmetrical axis 24, this is not much of a concern for long-putt practices over flat surface with the device fixed at an appropriate angle. However this would be a concern if the user intends to practice putting with curved ball trajectories, such as those involved if the putting surface is not perfectly flat and has varying contours. In such case the adjustment process of rotating the rim 18 and attached deflector 12 or rotating the entire mat 22 would have to be carried out to ensure that the device's symmetrical axis 24 is within plus or minus 5 degrees of the ball's 16 trajectory at contact.

Figure 3:
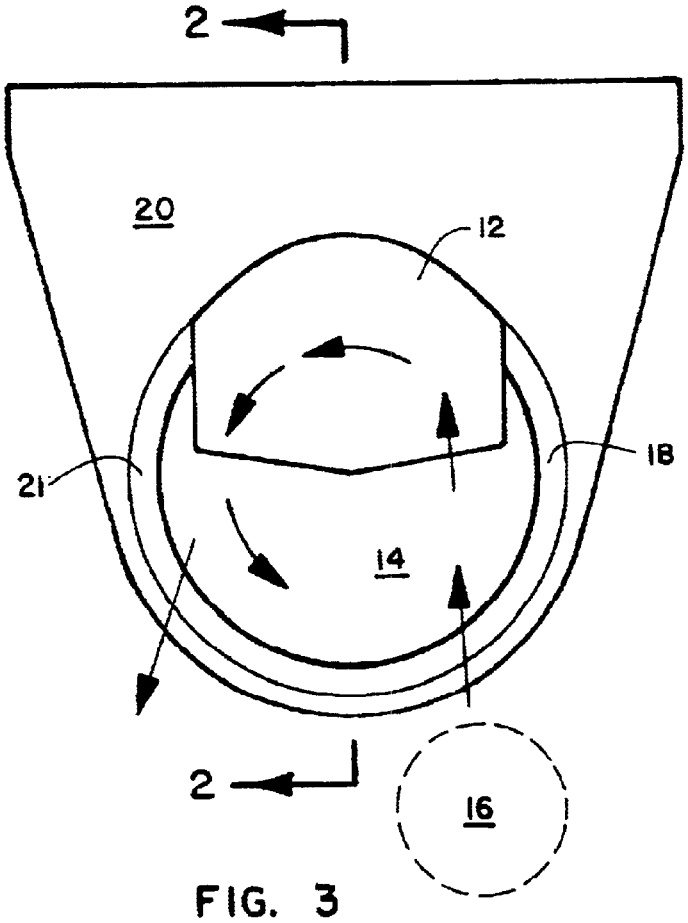
FIG. 3 is a top view of the disclosed device showing capture or rejection of the ball.
Figure 2:
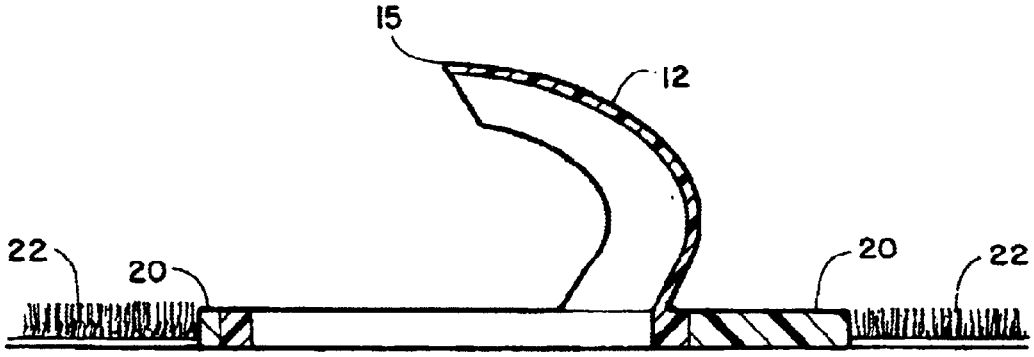
FIG. 2 is a side view of the device shown in FIG. 1.
Figure 4:
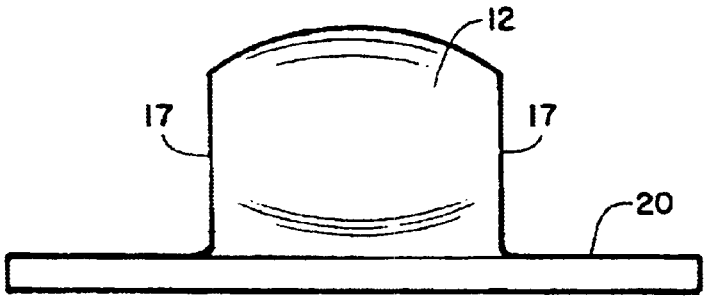
FIG. 4 is a rear view of the disclosed device.

Once the orientation of the main deflector 12 has been properly adjusted, the user can start putting practice and use the device as if it were an actual deep-cavity golf hole on the course. The device 12 functions using static entrapment and energy dissipation to drain off the right amount of momentum of the golf ball 16, such that the ball will be either trapped by falling into the cavity base 14 or will fall outside the device 10 according to its speed. As can be seen in FIG. 3, just like a ball's interaction with a real golf hole, the golf ball 16 is either trapped in the base cavity 14 or falls outside the base cavity 14 according to whether its speed is lower or higher than the highest determined or roll-drop speed which is the fastest speed at which the ball 16 in use on a conventional golf course, would fall into the hole without rolling over it. The highest roll drop speed varies according the amount of deviations of the ball's trajectory from the dead-straight central path. If the ball 16 is further from the central path, the smaller the highest roll-drop speed will be. The term "roll-drop" signifies the fact that the focus of study where most scores are achieved with the ball rolling into the hole instead of knocking at the flag pole and then dropping in. It is safe to assume that for such roll-drop to occur the ball would likely be in perfect rolling—i.e. its rotation is set to a state such that its surface's (changing) contact point with the ground has no relative motion—just prior to dropping into the hole. For a ball whose linear speed is v and radius is r, the perfect horizontal rolling speed w would be: $w=v*p/r$ (rad/sec). The near-perfect rolling will very likely occur in putting situations where the ball is more than 3 feet away from the hole.

There are two ways by which a ball would not roll-drop into the hole in putting situations due to its speed. One manner is the bounce-forth where the ball is moving so fast that it hits the opposite side of the cup and keeps moving out of the cup. The other is bounce-back of the ball where it hits the opposite end of the cup from entry and bounces back out of the hole toward the entry side. In some situations the slowest speed at which the ball misses the hole by bouncesforth (Vbf) is smaller than that by bounces-back (Vbb), and in other situations the opposite might happen. The ball with speeds between Vbf and Vbb would still fall into the hole. In such case the smaller of the two would be chosen as the Highest Roll Drop Speed (HRDS) because the ball's speeds in indoor putting practice are usually low.

The HRDS is an important functional measure for comparing the accuracies of putting practice systems in replicating the properties of a golf hole in an actual putting green. It varies with the deviations of the ball's path from the center of the hole (i.e. Off-center distance). The degree of 'hardness' of the contact between the ball and the soil around the hole also affects the HRDS. The precise modeling of ball-soil interaction in general is a very complex task. However due to the short duration of impact and for the purpose of comparing the functionality of the disclosed device 10 and other existing putting practice systems (where no real ball-soil interaction is involved), the ball-soil interaction can be approximated by the Poisson contact model, which is based on the coefficient-of-restitution (c.o.r.) computation. The Poisson model was chosen over other impact models because the contacts are intermittent and the main subject of investigation here was the loss of the ball's kinetic energy during the impacts.

The coefficients of restitution (c.o.r.) and friction (c.o.f.) of the ball-soil contacts are related to many factors such as dampness of the soil, texture of grass around the rim of the hole, hardness (compactness) of soil and the surface condition of the ball. Since these factors depend on conditions of different fields and at different times, and could vary significantly, it is not possible to fix the exact values for the coefficients. However it is quite safe to assume that the c.o.r varies between 0.1 to 0.4, with the span between 0.2 and 0.3 as more probable.

With these parameters established, the HRDS for a smoothed-surface ball with standard dimensions of a golf ball 16 (weighs 59.2 grams, diameter 21.33 mm) and golf hole has been found through computer simulations based on the Poisson contact model. It is observed that c.o.r. only affects the HRDS for the range between plus or minus 20 mm. This is due to the fact that the ball would only impact the rim of the hole between this range, and outside this range the ball would roll around the rim of before dropping down, and hence the c.o.r. is not influential.

The design of device 10 combines the principles of precise mechanical entrapment and energy dissipation to drain off the right amount of kinetic energy from the ball 16 when it comes into contact with the device 10, such that the ball will be either trapped, or will fall outside the device according to whether its speed and hence energy is lower or higher than the HRDS. To achieve this, a special contact contour and materials should be properly chosen to absorb quite a significant amount of the kinetic energy of the golf ball in order to trap it without a deep cavity. In the current best mode, materials forming the components of the device 10 should be of a calculated hardness to maintain the c.o.r. of the contacts between the ball 16 and the main components of the device at around 0.3 to 0.4, coefficients of restitution which would be quite easily achievable with a wide variety of materials.

The design and configuration of the curved shape of the inner surface 13 of the main deflector 12 is then calculated with this constraint preset, and formed to thereby drop the ball 16 into the base cavity 14 only for balls a speed equal to or less than the highest roll drop speed. The properly curved deflector 12 is attached at a base end to the rim 18 and is curved at a predetermined shape to its termination at the distal end 15 and side ends 17. The inner surface 13 defined by the area between the base end, the distal end 15 and the two side ends 17 is curved to a determined dimensional shape to deflect balls 16 traveling a determined speed which in this case is equal to or less than the highest roll drop speed, into the base cavity 14 formed inside the rim 18 and to eject balls 16 traveling at a rate higher than the highest determined roll drop speed as depicted in FIG. 3. As noted, this attachment to the rim 18 also allows the deflector 12 a means to rotate to the proper angle in relation to the incoming ball 16 to be struck by the user by either rotating the rim 18 if rotationally mounted, or the entire mat 22 if not rotationally mounted in the support base 20.

Stated in simpler terms, the components of the device 10 form a means to dissipate a determined amount of kinetic energy from a golf ball 16 striking the device 10 by adjusting the relative hardness of the components of the device 12 and forming a curve on the inner surface 13 of the deflector 12 to a shape determined to deflect the ball 16 traveling at or below a determined maximum ball speed when striking the inner surface 13 of the deflector 12 and at a determined proper approach angle, into the cavity base 14, and to reject any ball 16 from the device 10 which is traveling at either an angle outside the determined proper approach angle or a speed higher than the determined maximum ball or both.

Optionally, as depicted in FIG. 5, an optional surface layer of harder or softer energy absorbent material 26 may be applied to the base cavity 14 to further adjust the amount of kinetic energy dissipated from the ball 16 when entering the device 10. This embodiment would provide the user further control over the device 10.

While all of the fundamental characteristics and features of the disclosed golf practice device have been shown and described, it should be understood that various substitutions, modifications, and variations may be made by those skilled in the art without departing from the spirit or scope of the invention. Consequently, all such modifications and variations are included within the scope of the invention as defined by the following claims.

What is claimed is:

1. A golf practice device, for receiving a golf ball of determined mass comprising:

a planar base support having a top surface and having a base aperture formed in said top surface;

a base rim having a circumference sized to cooperatively engage with said base aperture, said base rim also having an upper surface substantially level with said top surface when said base rim is cooperatively engaged with said base aperture;

a main deflector attached at a base end to said base rim and having an inner surface area defined by said base end and two side edges terminating at a distal end;

said inner surface of said main deflector curved to dissipate a determined amount of the total kinetic energy from said golf ball when said golf ball is struck and rolls across the inner surface of said main deflector;

said golf ball deposited by said main deflector in a base cavity formed inside said base rim should said total kinetic energy of said ball encountering said main deflector be equal to or below a maximum determined force;

said main deflector having a symmetry axis therethrough;

said inner surface of said main deflector dimensioned to reject said ball from deposit into said base aperture should said golf ball hit into said main deflector have an angle of incidence with said main deflector exceeding substantially plus or minus 5 degrees from said symmetry axis; and said golf ball rejected by said main deflector and deflected from deposit in said base cavity should said total kinetic energy of said ball encountering said main deflector be above said maximum determined force, whereby golf balls struck to roll and encounter said main deflector with a force and angle of incidence determined to be sufficient to jump or miss a conventional hole in a green will be rejected from by said main deflector and golf balls struck to roll and encounter said main deflector with a force determined to be sufficiently low to allow said golf ball to drop into a conventional hole in a green will be deposited by said main deflector to entrapment in said base cavity.

2. The golf practice device as defined in claim 1 wherein said base rim cooperatively engages with said base aperture in a rotatably engagement therein thereby allowing adjustment of said main deflector to substantially face the direction of the user's anticipated approach angle of said ball when hit.

3. The golf practice device as defined in claim 1 wherein said base rim cooperatively engages with said base aperture in a rotatably engagement therein thereby allowing adjustment of said symmetry axis to the user's anticipated approach angle of said ball when hit.

4. The golf practice device as defined in claim 1 wherein said base support is a synthetic putting green surface.

5. The golf practice device as defined in claim 2 wherein said base support is a synthetic putting green surface.

6. The golf practice device as defined in claim 3 wherein said base support is a synthetic putting green surface.

7. The golf practice device as defined in claim 1 wherein said base cavity is recessed below said upper surface of said base rim a depth not exceeding 5 mm.

8. The golf practice device as defined in claim 2 wherein said base cavity is recessed below said upper surface of said base rim a depth not exceeding 5 mm.

9. The golf practice device as defined in claim 4 wherein said base cavity is recessed below said upper surface of said base rim a depth not exceeding 5 mm.

10. The golf practice device as defined in claim 5 wherein said base cavity is recessed below said upper surface of said base rim a depth not exceeding 5 mm.

11. The golf practice device as defined in claim 6 wherein said base cavity is recessed below said upper surface of said base rim a depth not exceeding 5 mm.

12. The golf practice device as defined in claim 1 wherein said main deflector is formed of a material of a hardness calculated to dissipate a first determined amount of said total kinetic energy of said golf;

said inner surface of said main deflector curved to dissipate a second determined amount of the total kinetic energy from said golf ball when said golf ball is struck and rolls across the inner surface of said main deflector;

the sum of said first determined amount of said total kinetic energy and said second determined amount of said total kinetic energy dissipated from said total kinetic energy of said golf ball being a total kinetic energy drained from said golf ball;

said golf ball will be deposited by said main deflector in said base cavity and captured in said base cavity formed inside said base rim should said total kinetic energy drained from said golf ball encountering said main deflector leave a total remaining kinetic energy in said golf ball equal to or below said maximum determined force; and said golf ball rejected by said main deflector and deflected from deposit in said base cavity should said total kinetic energy drained from said golf ball encountering said main deflector leave a total remaining kinetic energy above said maximum determined force, whereby golf balls struck to roll and encounter said main deflector with a force determined to be sufficient to jump or miss a conventional hole in a green will be rejected from by said main deflector and golf balls struck to roll and encounter said main deflector with a force determined to be sufficiently low to allow said golf ball to drop into a conventional hole in a green will be deposited by said main deflector to entrapment in said base cavity.

13. The golf practice device as defined in claim 12 wherein said base rim cooperatively engages with said base aperture in a rotatable engagement therein thereby allowing adjustment of said main deflector to substantially face the direction of the user's anticipated approach angle of said ball when hit.

14. The golf practice device as defined in claim 12 wherein said main deflector has a symmetry axis therethrough and said inner surface of said main deflector is dimensioned to reject said ball from deposit into said base aperture should said golf ball hit into said main deflector have an angle of incidence with said main deflector exceeding plus or minus 5 degrees from said symmetry axis.

15. The golf practice device as defined in claim 13 wherein said main deflector has a symmetry axis therethrough and said inner surface of said main deflector is dimensioned to reject said ball from deposit into said base aperture should said golf ball hit into said main deflector have an angle of incidence with said main deflector exceeding plus or minus 5 degrees from said symmetry axis.

16. The golf practice device as defined in claim 12 further comprising a layer of energy absorbent material on a top surface of said base cavity, said energy absorbent material calculated to absorb a determined amount of energy from said ball hitting said top surface.

17. The golf practice device as defined in claim 12 further comprising a layer of energy absorbent material on a top surface of said base cavity, said energy absorbent material dissipating a third determined amount of the total kinetic energy; and the sum of said first determined amount of said total kinetic energy and said second determined amount of said total kinetic energy and said third determined amount of said total kinetic energy, dissipated from said total kinetic energy of said golf ball being said total kinetic energy drained from said golf ball.

* * * * *